United States Patent [19]

Mueller et al.

[11] 4,232,354

[45] Nov. 4, 1980

[54] ELECTRICALLY ACTUATED LOCK FOR A DOOR OR SIMILAR ACCESS MEANS

[76] Inventors: Rand W. Mueller; Daniel L. Stec, both of 41400 Executive Dr., Mt. Clemens, Mich. 48045

[21] Appl. No.: 85

[22] Filed: Jan. 2, 1979

[51] Int. Cl.[3] ..... E05B 49/00

[52] U.S. Cl. ..... 361/172; 70/278; 340/147 MD

[58] Field of Search ..... 361/171, 172; 340/147 MD, 543; 70/278

[56] References Cited

U.S. PATENT DOCUMENTS

| | | | |
|---|---|---|---|
| 3,816,755 | 6/1974 | McMaster | 361/172 X |
| 4,021,796 | 5/1977 | Fawcett, Jr. et al. | 361/172 X |
| 4,062,056 | 12/1977 | Goodrich | 70/278 X |
| 4,083,424 | 4/1978 | von den Stemmen et al. | 70/278 X |

OTHER PUBLICATIONS

Fortuna, "Foil Car Thieves With 'Digistart'", *Popular Electronics,* Apr. 1977, pp. 48–49.

Wang, "Reader's Circuit", *Popular Electronics,* Dec. 1977, pp. 92–93.

*Primary Examiner*—J. D. Miller

*Assistant Examiner*—L. C. Schroeder

*Attorney, Agent, or Firm*—Oltsch, Knoblock & Hall

[57] ABSTRACT

An electrically actuated lock for a door or similar access means in which a multiple number of data bits are introduced in a given sequential manner into a plurality of series-connected data transfer parts each operable one at a time and in a selected sequence to finally cause the actuation and withdrawal of the latching mechanism for the lock.

4 Claims, 2 Drawing Figures

ELECTRICALLY ACTUATED LOCK FOR A DOOR OR SIMILAR ACCESS MEANS

SUMMARY OF THE INVENTION

This invention relates to a lock for a door or similar access means and will have specific application to an electrically actuated lock which receives from the lock user a multiple number of sequential data bits for the purpose of causing the release of the lock.

In the lock a plurality of series-connected flip-flops receive a combination of selected sequential data bits which causes the progressive actuation of the flip-flops, resulting in the withdrawal of the latch of the lock to allow the door or similar access means to be opened. If incorrect data bits or if the correct data bits in an improper sequence is introduced into the lock system, the flip-flops therein will not cooperatively actuate to cause the release of the latch of the lock. If desired, one or more selectors can be incorporated into the lock system to enable the lock user to determine his own input combination for actuating the lock mechanism.

The lock of this invention will find application in homes and businesses whereby entrance into the home or business building will be gained through utilization of the lock. The lock has a capability of utilizing a high number of combinations or data bits so as to render manipulation or duplication of the combination by an intruder essentially impossible.

Accordingly, it is an object of this invention to provide an electrical lock of reliable operation and of a high security factor.

Another object of this invention is to provide an electrically actuated lock which is for a door of a home or a business building and which includes a high number of possible combinations, rendering duplication of the combination by an intruder essentially impossible.

Still another object of this invention is to provide an electrically actuated lock which is for a door or similar access means and which is of economical construction.

Other objects of this invention will become apparent upon a reading of the invention's description.

BRIEF DESCRIPTION OF THE DRAWINGS

A preferred embodiment of this invention has been chosen for purposes of illustration and description wherein.

DESCRIPTION OF THE PREFERRED EMBODIMENT

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

Figure 1:
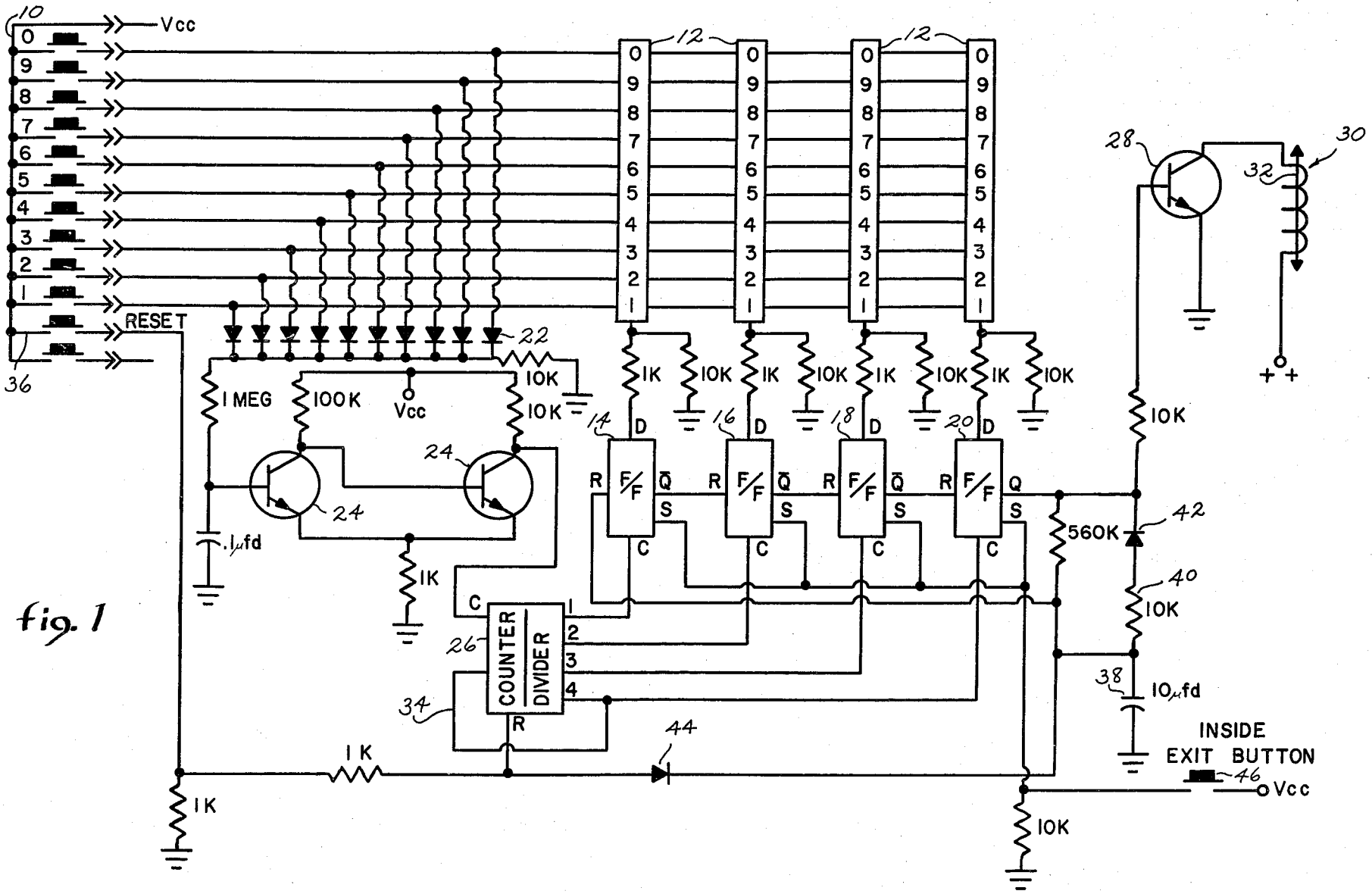
FIG. 1 is a circuit diagram of a lock of this invention.

Referring first to FIG. 1, a plurality of switches 10 are positioned at an exteriorally available location adjacent the door or similar access means to which the lock of this invention is associated. Switches 10 have exposed button actuators which may be numbered, as shown in FIG. 1, lettered or provided with any other type of symbol which would facilitate their identification by the user of the lock. When a switch 10 is actuated by pressing its actuator button, a data bit in the form of a pulse is created. Switches 10 are connected to a plurality of dial mechanisms 12. Each dial mechanism 12 includes a plurality of switch locations which correspond to the number of switches 10. The number of dial mechanisms 12 utilized for a particular lock can vary depending upon the number of data bits in a combination. In the lock illustrated, there are four data bits, or numbers in this case, used in the combination and thus there are four dial mechanisms 12 in the lock. All corresponding switch locations of dial members 12 are connected in parallel and in turn are connected as a group to a correspondingly designated switch 10. Each dial mechanism 12 is connected to the data input terminal D of a dual D type flip-flop 14–20.

Flip-flops 14–20 serve as data transfer parts in the lock system. Each flip-flop 14–20 includes a reset or actuator input terminal R, a clock input terminal C, a set or override input terminal S, and a data output terminal Q or $\overline{Q}$, depending whether an information output or an information not output is desired. The user of a lock selects four numbers in a particular order which will constitute the lock's combination. The first of these numbers is entered into that dial mechanism 12 connected to flip-flop 14 to connect the correspondingly numbered switch 10 with flip-flop 14. In like manner the second number of the combination is entered into the dial mechanism 12 connected to flip-flop 16 to connect the correspondingly numbered switch 10 with the flip-flop. The third number of the combination is entered into the dial mechanism connected to flip-flop 18 to connect the correspondingly numbered switch 10 with the flip-flop. And also the fourth number of the combination is entered into the dial mechanism connected to flip-flop 20 to connect the correspondingly numbered switch 10 to the flip-flop. The particular construction of each dial mechanism 12 can vary and may be of the thumb-actuated rotary dial type. Assuming for purposes of explanation that the combination of 7359 was selected by the lock user, the number 7 switch of switches 10 will be connected to input D of flip-flop 14, the number 3 switch connected to input D of flip-flop 16, the number 5 switch connected to input D of flip-flop 18, and the number 9 switch connected to input D of flip-flop 20. Dial mechanisms 12 as well as much of the circuitry for the lock, with the exception of switches 10, will be located in an inaccessible location to any intruder or unauthorized user of the lock. In the embodiment of the lock illustrated, by using four dial mechanisms 12 each with ten potential data bits, there are 10,000 different possible combinations.

Each switch 10 is also connected through a blocking diode 22 to a pulse generator which includes connected NPN transistors 24 and associated resistors and capacitor. The pulse generator of this type is commonly known as a Schmitt trigger. The output from the generator is connected to input C of a counter-divider 26, having a sequential pulsed output. In counter-divider 26, its first output is connected to input C of flip-flop 14, its second output is connected to input C of flip-flop 16, its third output is connected to input C of flip-flop 18, and its fourth output is connected to input C of flip-flop 20. Such a divider-counter may be of the RCA CD4022 type. The $\overline{Q}$ output of flip-flop 14 is connected to the reset or actuator terminal R of flip-flop 16. The $\overline{Q}$ output of flip-flop 16 is connected to the reset or actuator R of flip-flop 18 while in turn the $\overline{Q}$ output of the flip-flop 18 is connected to the reset or actuator R of flip-flop 20. The Q output of flip-flop 20 is connected to the base of a transistor 28. The collector of transistor 28 is connected to the actuating coil of a solenoid latch actuator 30. The rod 32 of latch actuator 30 forms part of the latching mechanism for a door or similar access means so that upon turn-on of transistor 28 the latch actuator causes movement of its rod 32 with a resulting release of the door or similar access means, such as a lid. For each flip-flop utilized in the lock of this invention, counter-divider 26 wll provide one pulsed output. In the illustrative embodiment, there are four flip-flops 14–20 utilized and therefore counter-divider 26 will provide four sequential outputs. After the fourth pulsed output, by virtue of feedback line 34, the counter will be automatically locked out and rendered inoperable until appropriately reset.

To operate the lock as thus far described, the lock user knowing the full data bit combination first pushes the reset button of an accessible switch 36 which serves to activate and reset counter-divider 26 in preparation for a four pulsed output. This is accomplished by having the reset switch connected to the R reset input of the counter-divider. After resetting the counter-divider 26, the lock user then enters the coded combination in sequential order by pushing the appropriate numbered buttons of switches 10. In our example of a combination of 7359, the user would first push button 7 to cause an input into a flip-flop 14 at D. Simultaneously the pulse generator through transistors 24 sends a pulse into input C of counter-divider 26 which emits a pulse through line 1 and into input C of flip-flop 14. Prior to the actuation of switches 10, the $\overline{Q}$'s of flip-flops 14, 16 and 18 are set high with the Q of flip-flop 20 set low. The R inputs of flip-flops 16, 18 and 20 are set high with the R input of flip-flop 14 being set low to enable the flip-fop 14 to receive pulses through its inputs C and D. Thus as the first data bit 7 is entered into the lock system by pushing the correspondingly numbered switch button, Q of flip-flop 14 is driven low which causes the R input of the adjacent flip-flop 16 to be driven low, thereby readying that flip-flop to receive pulses at its C and D inputs. The lock user now enters the second data bit by pushing the switch button representing number 3, causing again the generation of a pulse by the pulse generator and the emission of a pulse through counter-divider 26 at line 2. In this manner pulses are received nearly simultaneously at inputs C and D of flip-flop 16. This causes $\overline{Q}$ of flip-flop 16 to be driven low which drives the R input of the adjacent flip-flop 18 low, thereby readying flip-flop 18 to receive pulses at its C and D inputs. The lock user then enters the third data bit by pushing the switch button numbered 5. This causes a pulse generation with counter-divider 26 emitting a pulse through line 3. At this time pulses are received at inputs C and D of flip-flop 18. This causes $\overline{Q}$ of flip-flop 18 to go low with the driving of the R input of flip-flop 20 low. With R low of flip-flop 20, the lock user now pushes the switch button number 9 representing the last data bit of the four number combination causing another pulse to be generated by the pulse generator and the emission of a pulse through counter-divider 26 at line 4. Pulses are now received through inputs C and D of flip-flop 20 causing the Q output of flip-flop 20 which had been previously set low to go high so as to turn on transistor 28. At this point counter-divider 26 is locked out and remains inoperable until reset. Upon the turning on of transistor 28 the solenoid rod 32 is actuated to allow the opening of the door or other similar access means.

With Q of flip-flop 20 high, capacitor 38 is charged along with flip-flop 14 at its R input. In a few seconds the threshold voltage of flip-flop 14 is reached with its R input going high which drives $\overline{Q}$ high. As $\overline{Q}$ of flip-flop 14 is driven high the R input of flip-flop 16 and its $\overline{Q}$ are also driven high followed by the sequential driving of the R input of flip-flop 18 and its $\overline{Q}$ output high. Thereafter in sequential fashion the R input of flip-flop 20 goes high and its Q output goes low. As $\overline{Q}$ output of flip-flop 20 is driven low, transistor 28 is turned off causing the reinsertion of the latch of the lock. As Q of flip-flop 20 goes low, capacitor 38 discharges through resistor 40 and diode 42. As capacitor 38 is discharged, the R input of flip-flop 14 goes low in preparation for receiving the coded combination of data bits the next time the combination is again entered into the lock.

Diode 44 isolates capacitor 38 during its discharge from R or the reset input of counter-divider 26. This requires the lock user to manually reset counter-divider 26 prior to entering the data bit combination into the lock system. Should a mistake be made in entering the combination into the lock system, the lock user need only push the reset button which causes flip-flops 14–20 to be reset to again receive the data bit combination.

Should an unauthorized user attempt to operate the lock by entering the wrong data bit combination, the pulse generator and counter-divider 26, if appropriately reset first, will provide sequential pulses into the C inputs of flip-flops 14–20. But the flip-flops will not be sequentially activated since corresponding pulses are not received at their D inputs. As an example, should an intruder, even if first resetting counter-divider 26, enter a data bit number 5 instead of the proper 7 of our example combination the counter-divider will provide a pulse at input C of flip-flop 14 but there will be no corresponding pulse at input D since dial mechanism 12 attached to flip-flip 14 was not set to receive input data bit 5. The only circuit through dial mechanism 12 connected to flip-flop 14 is that for input data bit 7. Any other number and corresponding pushed button switch will not produce a pulse at input D of the flip-flop. Should an intruder even correctly guess the first digit of a combination, the remaining three digits would also have to be correctly entered into the lock in proper sequential order. If any one incorrect number is entered or if the correct numbers are entered out of sequential order, transistor 28 connected to the solenoid of latch actuator 30 will not be turned on.

If the lock of this invention is utilized to secure a door in a home or office building, means must be provided by which individuals inside the building can exit without the necessity of utilizing the combination. This is accomplished by providing an inside exit button 46 which when pushed serves to pulse the S set inputs of flip-flops 14–20, thereby overriding the flip-flops to cause the immediate turning on of transistor 28 and the opening actuation of latch rod 32. Once overridden, flip-flops 14–20 will operate in a fashion similar to that as if the combination had been correctly entered with capacitor 38 being charged and with the following sequential resetting of all the flip-flops and the turning off of transistor 28.

Figure 2:
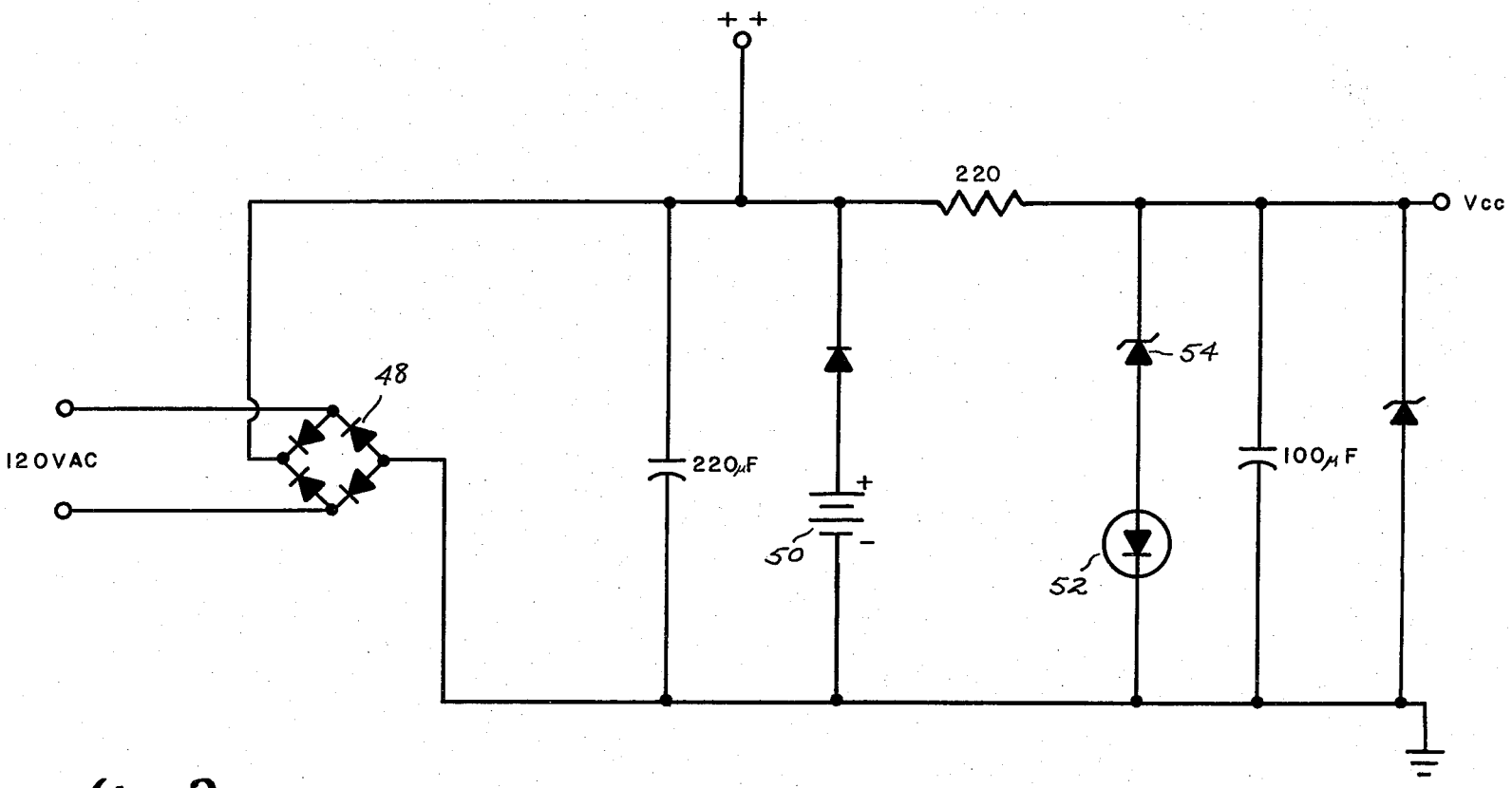
FIG. 2 is a power circuit for the circuit diagram of FIG. 1.

The power circuit for the lock system shown in FIG. 1 is found in FIG. 2. The system is operable from a normal 120 volt line current which is rectified through a diode bridge 48 into a usable direct voltage. Additionally, a battery 50 may also be provided within the power circuit for use during power failure and other periods of inoperability of the line current. Such a battery may be of the 9 volt variety. An LED 52 serves to provide a visual indication of the presence of a line voltage in the power circuit. Upon times of battery usage, zener diode 54 will turn diode 52 off. In this manner, the lock user will be able to ascertain whether the power for the lock system is coming from the line or whether it is being maintained through the supplemental battery source.

It is to be understood that the invention is not to be limited to details above given, but may be modified within the scope of the appended claims.

What we claim is:

1. In an electrically actuated lock for a door or similar access means having an opening input combination of a multiple number of data bits, said lock comprising latching means for securing said door, means upon electrical stimulation thereof for withdrawing said latching means to release said door, a plurality of transfer means, one such transfer means for each data bit, each transfer means for receiving first and second inputs responsive to an actuator input and having an output responsive to both said first and second inputs, said transfer means connected in series wherein the output of one transfer means serves as an actuator input for the next transfer means, individually actuated switching means accessible to the lock user for producing a pulsed input representing a data bit, a selected one of said switching means for providing the inputs to each transfer means, and the last of said series connected transfer means associated with said withdrawing means wherein the output thereof causes said electrical stimulation of the withdrawing means and release of said door, each switching means being associated with a pulse generator and counter means for sending a selected number of input pulses to said transfer means, said selected number being equal to the number of data bits in said combination, and means for rendering the counter of said pulse generator and counter means inoperable after said selected number of pulses has been sent to said transfer means.

2. The lock of claim 1 and means accessible to said lock user for rendering said counter operable after said selected number of pulses has been sent to said transfer means and before actuating said switching means.

3. The lock of claim 1 and means associated with each switching means inaccessible to said lock user for connecting said selected switching means to said transfer means to provide said first input thereto, said pulse generator and counter means for providing said second input to said transfer means.

4. The lock of claim 3 wherein each transfer means after having once received an actuator input requires resetting to again receive the actuator input, and delayed means for resetting said transfer means upon stimulation of said means for withdrawing said latching means wherein resetting of said last in the series connected transfer means causes replacement of the latching means.

* * * * *